US007815778B2

(12) United States Patent
Bajaj

(10) Patent No.: US 7,815,778 B2
(45) Date of Patent: Oct. 19, 2010

(54) ELECTRO-CHEMICAL MECHANICAL PLANARIZATION PAD WITH UNIFORM POLISH PERFORMANCE

(75) Inventor: Rajeev Bajaj, Fremont, CA (US)

(73) Assignee: Semiquest Inc., San Jose, CA (US)

( * ) Notice: Subject to any disclaimer, the term of this patent is extended or adjusted under 35 U.S.C. 154(b) by 1002 days.

(21) Appl. No.: 11/562,310

(22) Filed: Nov. 21, 2006

(65) Prior Publication Data

US 2007/0131564 A1 Jun. 14, 2007

Related U.S. Application Data

(60) Provisional application No. 60/739,252, filed on Nov. 23, 2005, provisional application No. 60/758,006, filed on Jan. 10, 2006.

(51) Int. Cl.

| | |
|---|---|
| ***B23H 5/06*** | (2006.01) |
| ***B23H 5/08*** | (2006.01) |
| ***B23H 5/10*** | (2006.01) |
| ***C25F 3/16*** | (2006.01) |
| ***C25F 3/18*** | (2006.01) |
| ***C25F 3/30*** | (2006.01) |

(52) U.S. Cl. ..... 204/224 M; 204/242; 204/279; 205/662; 205/663; 205/668

(58) Field of Classification Search ..... None
See application file for complete search history.

(56) References Cited

U.S. PATENT DOCUMENTS 5,212,910 A 5/1993 Breivogel et al.
5,489,233 A 2/1996 Cook et al.

(Continued)

FOREIGN PATENT DOCUMENTS

JP 2001071256 A 3/2001

(Continued)

OTHER PUBLICATIONS

Bajaj, Rajeev, PCT/US05/35978, International Search Report and Written Opinion, Mar. 15, 2006, 10pp, International Searching Authority-US, Alexandria, Virginia.

(Continued)

*Primary Examiner*—Harry D Wilkins, III
(74) *Attorney, Agent, or Firm*—Sonnenschein Nath & Rosenthal LLP

(57) ABSTRACT

A polishing pad includes at least one conductive polishing element supported by a compressible under layer having conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer. The polishing pad may further include a proton exchange membrane placed over the cathodic element. A semiconductor wafer having a metal film thereon may be polished using the polishing pad by placing the wafer in contact with the polishing element, applying anodic current to the polishing element and cathodic current to the cathodic element, and polishing with an anodic solution. For copper films, a sulfuric acid-copper sulfate solution may be used.

20 Claims, 2 Drawing Sheets

U.S. PATENT DOCUMENTS

| | | | | |
|---|---|---|---|---|
| 5,607,346 | A | 3/1997 | Wilson et al. | |
| 5,609,517 | A | 3/1997 | Lofaro | |
| 5,795,218 | A | 8/1998 | Doan et al. | |
| 5,893,976 | A | 4/1999 | Bauer | |
| 6,019,666 | A | 2/2000 | Roberts et al. | |
| 6,024,630 | A | 2/2000 | Shendon et al. | |
| 6,089,965 | A | 7/2000 | Otawa et al. | |
| 6,090,475 | A | 7/2000 | Robinson et al. | |
| 6,498,101 | B1 | 12/2002 | Wang | |
| 6,612,916 | B2 | 9/2003 | Kollodge et al. | |
| 6,794,605 | B2 | 9/2004 | Park et al. | |
| 6,962,524 | B2 | 11/2005 | Butterfield et al. | |
| 6,986,705 | B2 | 1/2006 | Preston et al. | |
| 7,020,306 | B2 | 3/2006 | Hirose et al. | |
| 7,192,340 | B2 | 3/2007 | Ono et al. | |
| 2001/0035354 | A1* | 11/2001 | Ashjaee et al. | 205/103 |
| 2001/0039175 | A1 | 11/2001 | Golzarian et al. | |
| 2002/0173255 | A1 | 11/2002 | Shendon et al. | |
| 2003/0132120 | A1 | 7/2003 | Emesh et al. | |
| 2003/0153245 | A1 | 8/2003 | Talieh et al. | |
| 2003/0209528 | A1 | 11/2003 | Choo et al. | |
| 2003/0220053 | A1* | 11/2003 | Manens et al. | 451/41 |
| 2004/0110381 | A1 | 6/2004 | Yoshida | |
| 2004/0163946 | A1* | 8/2004 | Chang et al. | 204/224 M |
| 2004/0163950 | A1* | 8/2004 | Emesh | 204/297.06 |
| 2004/0166779 | A1 | 8/2004 | Balijepalli et al. | |
| 2004/0214510 | A1* | 10/2004 | So | 451/41 |
| 2004/0232121 | A1 | 11/2004 | Park et al. | |
| 2005/0061674 | A1* | 3/2005 | Wang et al. | 205/78 |
| 2005/0092621 | A1* | 5/2005 | Hu et al. | 205/668 |
| 2005/0124262 | A1* | 6/2005 | Manens | 451/5 |
| 2005/0159084 | A1* | 7/2005 | Basol et al. | 451/41 |
| 2006/0079159 | A1 | 4/2006 | Naujok et al. | |

FOREIGN PATENT DOCUMENTS

JP 2004-255478 A * 9/2004

OTHER PUBLICATIONS

Bajaj, Rajeev, PCT/US05/35979 filed Oct. 5, 2005, International Search Report and Written Opinion, Feb. 24, 2006, 8pp, International Searching Authority-US, Alexandria, Virginia.

Bajaj, Rajeev, PCT/US05/35732 filed Oct. 5, 2005, International Search Report and Written Opinion, Nov. 28, 2006, 6pp, International Searching Authority-US, Alexandria, Virginia.

Bajaj, Rajeev, PCT/US05/35660 filed Oct. 5, 2005, International Search Report and Written Opinion, Jun. 15, 2007, 8pp, International Searching Authority-US, Alexandria, Virginia.

Bajaj, Rajeev; PCT/US05/35978 filed Oct. 5, 2005; International Preliminary Report on Patentability; WIPO; Jun. 7, 2007; 7pp.

Bajaj, Rajeev; PCT/US05/35979 filed Oct. 5, 2005; International Preliminary Report on Patentability; IPEA/US; Sep. 27, 2006; 7pp.

Bajaj, Rajeev; PCT/US05/35732 filed Oct. 5, 2005; International Preliminary Report on Patentability; WIPO; Jun. 7, 2007; 5pp.

Bajaj, Rajeev; PCT/US05/35660 filed Oct. 5, 2005; International Preliminary Report on Patentability; WIPO; Jul. 19, 2007; 6pp.

* cited by examiner

ELECTRO-CHEMICAL MECHANICAL PLANARIZATION PAD WITH UNIFORM POLISH PERFORMANCE

RELATED APPLICATIONS

The present application is a non-provisional of, claims priority to and incorporates by reference U.S. provisional patent application No. 60/739,252, filed 23 Nov. 2005; and U.S. provisional patent application No. 60/758,006, filed 10 Jan. 2006.

FIELD OF THE INVENTION

The present invention relates to the field of electro-chemical mechanical planarization (ECMP) and relates specifically to methods of using engineered polishing pads in ECMP processes.

BACKGROUND

In modern integrated circuit (IC) fabrication, layers of material are applied to embedded structures previously formed on semiconductor wafers. Chemical mechanical planarization (CMP) is an abrasive process used to remove these layers and polish the surface of a wafer flat to achieve a desired structure. CMP may be performed on both oxides and metals and generally involves the use of chemical slurries applied in conjunction with a polishing pad in motion relative to the wafer (e.g., pad rotation relative to the wafer). The resulting smooth flat surface is necessary to maintain the photolithographic depth of focus for subsequent steps, and to ensure that the metal interconnects are not deformed over contour steps. Damascene processing requires metal, such as tungsten or copper, to be removed from the top surface of a dielectric to define interconnect structures, using CMP.

As CMP is a chemical-mechanical process, planarization/polishing performance is impacted by the mechanical properties and the slurry distribution ability of the polishing pad. Polishing slurries are formulated to cause passivation layers on the wafer surface, which layers are removed by the mechanical action of the pad. Higher points on the wafer are subject to higher pressure while lower points are protected by passivation and the inability of the pad to reach them. As advanced technology requirements are to be met, low K dielectric materials have to be used. These materials have low mechanical strength and cannot be polished with traditional down force processes.

FIG. 1 illustrates the surface of post-CMP copper wafer 100 polished with a traditional polishing pad alone. The low K dielectric material 102 is capped with a protective dielectric 104 such as silicon dioxide, silicon nitride or silicon carbide. Copper features 106 are etched into the dielectric stack. After polishing with a standard process besides dishing and erosion, damage to dielectric stack is seen in the form of material damage 108 or delamination 110. It is desirable to have a pad that can enable good planarization performance with low or near-zero down force.

SUMMARY OF THE INVENTION

A polishing pad configured in accordance with an embodiment of the present invention includes at least one conductive polishing element supported by a compressible under layer having conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer. The polishing pad may further include a proton exchange membrane placed over the cathodic element.

The conductive polishing element may be made of a conductive polymer, graphite or a combination of graphite and a conducting or non-conducting polymer. Alternatively, or in addition, the conductive polishing element may be coated with a non-conducting material other than at its top and bottom.

In further embodiments, the conductive polishing element generally has a top portion and a base, and the diameter of the base is preferably larger than the diameter of the top portion and the hole in the guide plate. The conductive polishing element may be adapted to make rolling contact with a metal film on an article undergoing polishing (e.g., by having a rounded tip).

In still other embodiments, the polishing pad may include a combination of electrically conductive and electrically non-conductive polishing elements. The guide plate may therefore have a number of thru holes arranged in a pre-determined pattern for accommodating the polishing elements. The conductive polishing elements may be made of one or more of a conductive polymer, graphite or combination thereof, while the non-conductive polishing elements may be made of a thermoplastic polymer such as polyurethane, Delrin, nylon, etc. These different polishing elements may have the same shape or different shapes.

The conductive patterning in the polishing pad may be made of copper, while the guide plate may be made of polycarbonate. The slurry distribution layer may be a polyethylene open cell foam having a pore size of approximately 10-50 microns. The compressible under layer may be one of: a polyurethane foam, a rubber foam, a solid polyurethane, or a solid rubber.

A semiconductor wafer having a metal film thereon may be polished with a polishing pad having at least one conductive polishing element supported by a compressible under layer with conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer. Such polishing may include placing the wafer in contact with the polishing element, applying anodic current to the polishing element and cathodic current to the cathodic element, and polishing with an anodic solution.

Further, a semiconductor wafer having a copper film thereon may be polished with a polishing pad having at least one conductive polishing element supported by a compressible under layer with conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer. Such polishing may include placing the wafer in contact with the polishing element and supplying a sulfuric acid-copper sulfate solution while applying anodic current to the polishing element and cathodic current to cathodic element.

BRIEF DESCRIPTION OF THE DRAWINGS

The present invention is illustrated by way of example, and not limitation, in the figures of the accompanying drawings, in which.

DETAILED DESCRIPTION

The present invention relates to electrochemical-mechanical polishing (ECMP) pads adapted to permit the use of low down force CMP. Although discussed with reference to certain illustrated embodiments, however, the scope of the invention should be measured only in terms of the claims following this description.

CMP processes require a balance of chemical and mechanical force to achieve removal of material from high points and thereby planarize an article. With the advent of damascene processing, copper CMP is one of the most critical processes in IC fabrication. Typical copper CMP processes have operated at down forces in the range of 3-5 Psi. Moderate operating pressures (3-5 Psi) are adequate when using silicon dioxide as a dielectric to inlay copper interconnects. As more advanced technologies for 90 nm, 65 nm and 45 nm are under consideration and development, lower K dielectrics need to be utilized to achieve desired circuit performance. These low K materials may be carbon-doped silicon dioxide or other materials made porous for even lower K performance. Typical Young's modulus values of silicon dioxides is on the order of 70 GPa and it drops to 10-15 Gpa for carbon-doped films. Porous materials are expected to have even lower strength. It is therefore necessary to mitigate or completely replace the need for down force to achieve desired planarization and removal performance for copper interconnects.

The engineered CMP pad described herein may be used in a variety of steps associated with CMP processing through selection of appropriate polishing elements and electrolytic chemistries. Such polishing elements are preferably made of conducting material.

Figure 1:
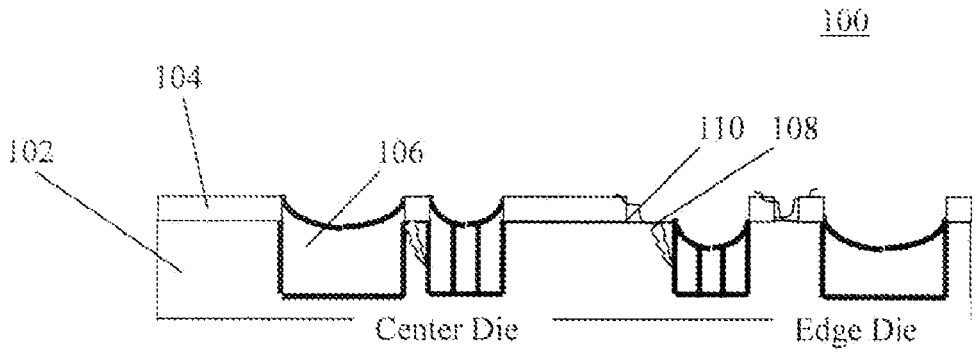
FIG. 1 illustrates examples of the types of damage which may occur to a wafer surface using conventional polishing pads.
Figure 2A:
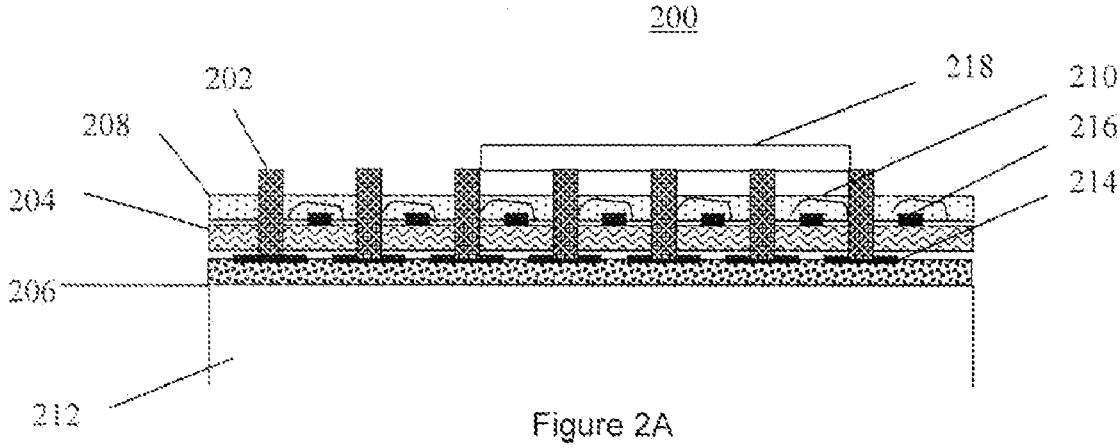
FIG. 2A illustrates a cut-away side profile view of a circular engineered ECMP pad configured according to one embodiment of the present invention.

FIG. 2A illustrates a cut-away side profile view of a circular engineered ECMP pad 200, configured according to one embodiment of the present invention. Pad 200 is placed on polish table 212. Polishing elements 202 are placed through a guide plate 204 and supported by compressible foam layer 206. A fluid distribution layer 208 is adhered on top of the guide plate 204 and a cathodic conductive element 216 is placed between the guide plate and the fluid distribution layer. An optional proton exchange membrane 210 may be placed over the cathodic conductive element. During polishing, the ECMP pad 200 is placed on the polishing table 212, which rotates relative to wafer 218 as the wafer contacts the polishing elements 202.

At the core of the engineered polishing pad is the guide plate 204 and compressible foam layer 206. The guide plate 204 provides lateral support for the polishing elements 202 and may be made of a conducting or non-conducting material or combination of the two. Conductive polishing elements 202 are made such that they have a conductive core and a non-conducting coating except the top surface, which is in contact with the wafer. In one embodiment of the present invention, the guide plate 204 includes holes fabricated into or drilled out of the guide plate 204 to accommodate each of the polishing elements 202.

The polishing elements 202 may protrude above surface of the guide plate 204, as illustrated. The polishing elements may be of varying geometric shapes (e.g., circular and/or triangular cross sections).

The compressible under layer 206 provides, among others features, a positive pressure directed toward the polishing surface when compressed. Typically, the compression may vary around 10% at 5 psi (pounds per square inch), however, it will be appreciated that the compression may be varied dependent upon the materials used in constructing the engineered polishing pad 200 and the type of ECMP process. For example, the compressible under layer 206 may be BOND-TEX™ made by RBX Industries, Inc.

Figure 2B:
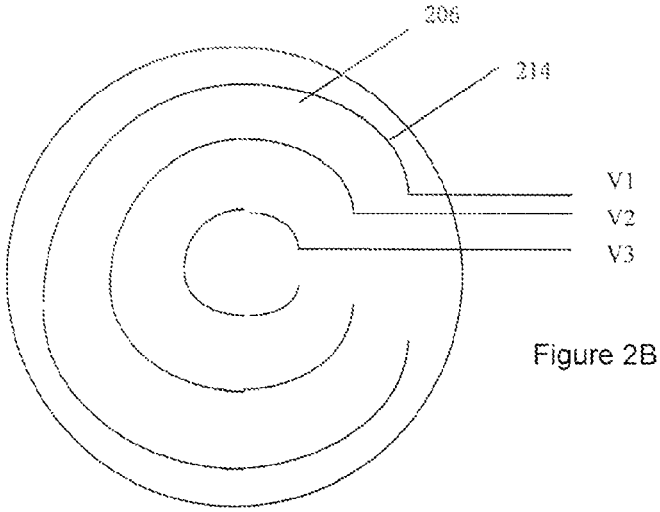
FIG. 2B illustrates the compressible foam under layer of the ECMP pad shown in FIG. 2A with conductive patterning laid out in a concentric manner to enable the potential of the polishing elements to be controlled in the radial direction.

FIG. 2B shows compressible foam layer 206 with conductive patterning 214. The pattern is laid out in a concentric manner to enable the potential of the polishing elements to be controlled in the radial direction. Potential for each ring of the various concentric patterns can be independently adjusted to V1, V2, V3, etc., respectively (although only three voltage rings are illustrated in the figure, it should be appreciated that any number of such rings could be used). It should be understood that the conductive patterning can be achieved in any manner required for the process.

Figure 2C:
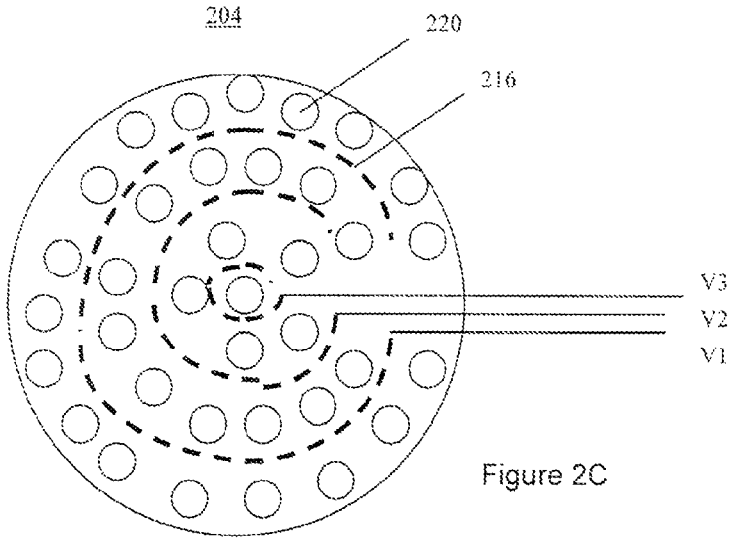
FIG. 2C illustrates the guide plate of the ECMP pad shown in FIG. 2A with holes for the polishing elements and cathodic elements arranged between the holes.
Figure 3:
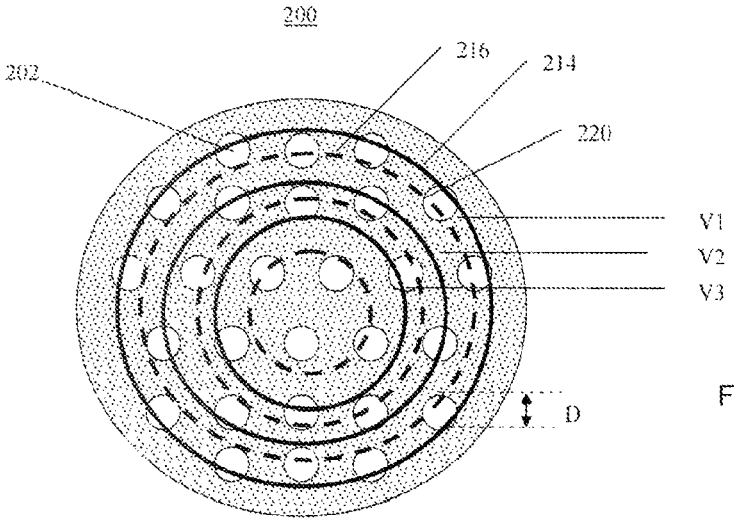
FIG. 3 illustrates a top down view of the ECMP pad configured according to one embodiment of the present invention.

FIG. 2C shows guide plate 204 with holes 220 for the polishing elements and cathodic elements 216 arranged between the holes. The cathodic elements 216 are laid out in a concentric arrangement providing control across the pad in a radial manner. The potential for each concentric ring corresponds to an appropriate anodic ring at V1, V2, V3, etc., respectively. It is understood that the conductive patterning can be achieved in any manner required for the process FIG. 3 illustrates a top down view of an engineered polishing pad 200, configured according to one embodiment of the present invention. The conductive polishing elements 202 are interdigitated throughout the pad 300 and the distribution of the polishing elements may vary according to specific requirements. In varying embodiments, the polishing elements 202 may have a density of between 30 and 80 percent of the total pad surface area, as determined by the diameter (D) of each polishing element and the diameter of the polishing pad. In one embodiment, the diameter (D) is at least 50 micrometers. In other embodiments, the diameter (D) is between 50 micrometers and 25 millimeters.

Figure 4:
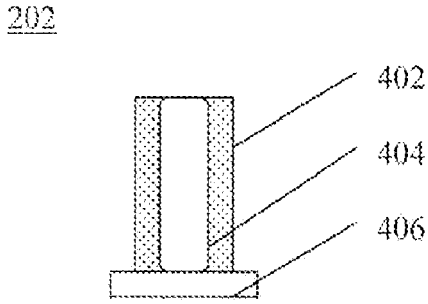
FIG. 4 illustrates a polishing element for the ECMP pad shown in FIG. 2 configured according to one embodiment of the invention.

FIG. 4 illustrates a polishing element 202, configured according to one embodiment of the invention. The element has a conductive core 404 and a non conducting shell 402 which occupies the top portion of the element. The element has a base 406 which has a size greater than the diameter of the top portion of the element and also greater than the size of the opening in the guide plate. It should be understood that a non-conducting element may be constructed from same shape.

Thus, an ECMP pad adapted to permit the use of low down force CMP has been described. The present ECMP pad has the capability to provide uniform pressure across a wafer undergoing polishing. During such polishing operations, the ECMP pad is placed on a polish table, a wafer is pressed against the pad to ensure good contact with the conductive polish elements and an electrolytic solution is supplied to the pad surface (i.e., the fluid distribution layer 208). An anodic potential is applied to the elements in contact with the wafer (i.e., the conductive polishing elements) while a cathodic potential is applied to a counter surface. For example, the anodic potential may be applied through conductive patterning 214 in the compressible under layer, which the cathodic potential may be applied to the guide plate through cathodic elements 216. As discussed above, the cathodic element may be placed between the fluid distribution layer and the guide plate. The polishing elements may be made (at least in part) of an electrically conductive material, and protrude through holes in the guide plate. The polishing elements are supported at their base by the compressible under layer. An optional proton exchange membrane may be applied on top of the cathodic element and below the fluid distribution layer, enabling separation of anodic and cathodic halves of the electrolytic cell.

During polishing, a wafer is placed on top of the conductive polishing elements in the presence of an electrolytic solution while a potential is applied to the cathodic element. This causes the electrochemical circuit to be completed, causing the metal film on the wafer to dissolve into the anodic solution while a reduction reaction is observed on the cathode. In the case of a copper film, for example, the electrolytic solution may be copper sulfate or sulfuric acid. The electrolytic solution may or may not contain an inhibitor to limit the removal of copper. The copper removal rate may be regulated by the number of anodic contact elements, the strength of the electrolytic solution, and the distance between the anodes.

One advantage of the present system is that it allows for multiple contact points ensuring a uniform potential across the wafer (which is specially useful for thin film removal). The present ECMP pad design also enables multiple potentials to be applied across the wafer, through anodic or cathodic channels.

The polishing elements apply local pressure to the wafer to achieve electrical contact and initiate removal. Since removal is electro-chemically driven, pressure or down force is used only to ensure good contact between the pad and the wafer and not for removal; hence, very low down force is required to achieve desired material removal results. The polish elements are able to move independently of one another in a vertical axis (i.e., normal to the wafer surface) to apply pressure on the wafer. This enables the elements to apply uniform pressure while complying with pressure tolerances at a global level. This eliminates "hot spots" on the wafer which might cause local pressure variations or, in case of low K materials, initiate material or interface failure damage. As will be evident to those of ordinary skill in the art, this structure also ensures good WIWNU at low down force for CMP pads and uniform electrical contact for ECMP pads enabling multiple contacts to work repeatably.

In varying embodiments of the present invention, the polishing elements may be made of any suitable conducting material such as carbon-filled polymer, metal, graphite or combination thereof and are capable of movement in the vertical axis. Further, polishing elements may be of different sizes and/or geometries may used with varying density across the pad surface and a combination of conducting and non-conducting elements may be used in the pad.

In still other embodiments, the polishing pad may include a combination of electrically conductive and electrically non-conductive polishing elements. The guide plate may therefore have a number of thru holes arranged in a pre-determined pattern for accommodating the polishing elements. The conductive polishing elements may be made of one or more of a conductive polymer, graphite or combination thereof, while the non-conductive polishing elements may be made of a thermoplastic polymer such as polyurethane, Delrin, nylon, etc. These different polishing elements may have the same shape or different shapes.

The conductive patterning in the polishing pad may be made of copper, while the guide plate may be made of polycarbonate. The slurry distribution layer may be a polyethylene open cell foam having a pore size of approximately 10-50 microns. The compressible under layer may be one of: a polyurethane foam, a rubber foam, a solid polyurethane, or a solid rubber.

In some cases, a copper pad may be placed on one polishing platen and barrier pad placed on another platen to remove copper and barrier material sequentially, utilizing separate copper and barrier solutions. The copper pad (whether used separately or in combination with the barrier material removal pad) may be used in combination with a copper sulfate/sulfuric acid solution on the anodic side and silver nitrate on the cathodic side. In yet another embodiment the electrolytic solution may contain an inhibitor such as benzotriazole to inhibit the removal of copper.

What is claimed is:

1. A polishing pad, comprising at least one conductive polishing element supported by a compressible under layer having conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer.

2. The polishing pad of claim 1, further comprising a proton exchange membrane placed over the cathodic element.

3. The polishing pad of claim 1, wherein the conductive polishing element is made of conductive polymer.

4. The polishing pad of claim 1, wherein the conductive polishing element is made of graphite.

5. The polishing pad of claim 1, wherein the conductive polishing element is made of a combination of graphite and a conducting or non-conducting polymer.

6. The polishing pad of claim 1, wherein the conductive polishing element is coated with a non-conducting material except at its top and bottom.

7. The polishing pad of claim 1, wherein the conductive polishing element has a top portion and a base, a diameter of the base being larger than a diameter of the top portion and the hole in the guide plate.

8. The polishing pad of claim 1, wherein the conductive polishing element is adapted to make rolling contact with a metal film on an article undergoing polishing.

9. The polishing pad of claim 1, further comprising a combination of electrically conductive and electrically non-conductive polishing elements.

10. The polishing pad of claim 9, wherein the guide plate has a number of thru holes arranged in a pre-determined pattern for accommodating the polishing elements.

11. The polishing pad of claim 9, wherein the conductive polishing elements are made of one or more of a conductive polymer, graphite or combination thereof.

12. The polishing pad of claim 9, wherein the non-conductive polishing elements are made of a thermoplastic polymer.

13. The polishing pad of claim 9, wherein the conductive polishing elements and non-conductive polishing elements have the same shape.

14. The polishing pad of claim 9, wherein the conductive polishing elements and non-conductive polishing elements have different shapes.

15. The polishing pad of claim 1, wherein the conductive patterning is made of copper.

16. The polishing pad of claim 1, wherein the guide plate is made of polycarbonate.

17. The polishing pad of claim 1, wherein the slurry distribution layer is a polyethylene open cell foam having a pore size of approximately 10-50 microns.

18. The polishing pad of claim 1, wherein the compressible under layer comprises one of: a polyurethane foam, a rubber foam, a solid polyurethane, or a solid rubber.

19. A method of polishing a semiconductor wafer having a metal film thereon, comprising polishing the wafer with a polishing pad having at least one conductive polishing element supported by a compressible under layer with conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer; said polishing including placing the wafer in contact with the polishing element, applying anodic current to the polishing element and cathodic current to the cathodic element, and polishing with an anodic solution.

20. A method of polishing a semiconductor wafer having a copper film thereon, comprising polishing the wafer with a polishing pad having at least one conductive polishing element supported by a compressible under layer with conductive patterning therein, the conductive patterning adapted to permit coupling of a potential to the conductive polishing element; a guide plate above the compressible under layer, the guide plate having a hole through which the polishing element passes and further having a cathodic element connected thereto; and a slurry distribution layer adhered to the guide plate opposite the compressible under layer; said polishing including placing the wafer in contact with the polishing element and supplying a sulfuric acid-copper sulfate solution while applying anodic current to the polishing element and cathodic current to cathodic element.

* * * * *